United States Patent [19]

Harrigan

[11] Patent Number: 4,768,688

[45] Date of Patent: Sep. 6, 1988

[54] SUNTAN LOTION BRACELET

[76] Inventor: Roy M. Harrigan, Bromley Mountain Rd., Manchester, Vt. 05254

[21] Appl. No.: 855,442

[22] Filed: Apr. 24, 1986

[51] Int. Cl.[4] ..... A44C 5/00

[52] U.S. Cl. ..... 224/148; 63/3; 222/175; 222/215; 222/530; 224/219; 206/823; 206/37

[58] Field of Search ..... 63/2, 1 R, 3, DIG. 2, 63/11; 222/465.1, 475, 192, 78, 215, 530, 538, 175; 224/148, 219; D11/2, 3, 4; D9/382, 378; 206/37, 823; 220/DIG. 13, DIG. 14

[56] References Cited

U.S. PATENT DOCUMENTS

| | | | |
|---|---|---|---|
| D. 86,570 | 3/1932 | Humphreys | D9/382 |
| D. 196,534 | 10/1963 | Vanderhyde | D9/382 |
| 655,025 | 7/1900 | Simon | 63/11 |
| 839,047 | 12/1906 | Sylvester | 63/3 |
| 2,086,493 | 7/1937 | Ellingwood | 63/3 |
| 2,235,350 | 3/1941 | Anderson | 224/148 |
| 2,449,181 | 9/1948 | Smiley | D11/4 |
| 2,738,616 | 3/1956 | Windle | D11/2 |
| 2,771,768 | 11/1956 | Tudor | 63/3 X |
| 3,559,854 | 2/1971 | Loveland | 63/1 R |
| 4,058,237 | 11/1977 | Luke | 222/175 |
| 4,502,298 | 3/1985 | Benton | 224/219 |

FOREIGN PATENT DOCUMENTS

| | | | |
|---|---|---|---|
| 16564 | of 1887 | United Kingdom | 63/DIG. 2 |
| 204657 | 10/1923 | United Kingdom | 63/DIG. 2 |

*Primary Examiner*—Richard J. Johnson

*Attorney, Agent, or Firm*—Charles C. Logan, II

[57] ABSTRACT

A suntan lotion bracelet formed from a tubular body configured in the shape of a ring. The interior of the tubular body forms a chamber for receiving a liquid suntan lotion or other liquids or lotions to be applied to the human body, particularly, lotions, the effectiveness of which is enhanced by maintaining a fairly constant dosage level through the day. The tubular body can have a variety of structures for filling the chamber with suntan lotion and for dispensing of the same. In certain embodiments of the suntan lotion bracelet, the tubular body has both of its opposite ends open and they respectively receive a female end cap and a male end cap that are detachably engaged to each other. The female cap has a nozzle portion having an orifice therein through which the chamber of the tubular body is filled with liquid suntan lotion and the same orifice acts as a dispensing orifice. In other embodiments of the suntan bracelet, the tubular body is formed as a non ending ring and a neck portion support wall is formed in its external surface and a neck portion extends upwardly therefrom. The neck portion has an orifice usable for filling the interior of the tubular body with suntan lotion and also for dispensing the same. Different types of caps may be configured to close the top of the neck portion.

9 Claims, 3 Drawing Sheets

SUNTAN LOTION BRACELET

BACKGROUND OF THE INVENTION

The invention relates to a bracelet, and more specifically to a bracelet having a tubular body configured in the shape of a ring and having an interior which forms a chamber whose preferred use is for receiving a liquid suntan lotion. It is to be understood that other types of liquids could be received in the chamber of the bracelet, particularily those to be applied to the human body whose effectiveness is enhanced by maintaining a fairly constant dosage level throughout the day, such as insect repellants or moisturizing lotions.

In the past it has been the practice of marketing suntan lotion in conventional type dispenser bottles. These bottles are made of plastic material and generally contain from 4 to 10 ounces of suntan lotion. In order to enhance portability there have also been manufactured small tubes containing fractions of an ounce of sunscreen.

A person going to the swimming pool or to the beach will usually carry their suntan lotion container in their hand or in some type of a bag. Often as they move about, swim, or are engaged in other activities they will need to reapply their lotion to maintain a constant level of effectiveness. Generally people find it inconvenient to carry in their hands, pocket or external bag convetional lotion containers.

It is an object of the invention to provide a novel suntan lotion bracelet that allows the person to carry their suntan lotion on their arm in the interior of a plastic bracelet.

It is also an object of the invention to provide a novel suntan lotion bracelet that allows the user to carry enough lotion to maintain an effective level of protection for a full outing without the burden of carrying jars, tubes or bottles.

It is another object of the invention to provide a novel suntan lotion bracelet that is economical to manufacture and market.

It is an additional object of the invention to provide a novel suntan lotion container that can be worn on a person's arm or ankle.

It is a further object of the invention to provide a novel bracelet that combines fashion and practicality.

SUMMARY OF THE INVENTION

Applicant's novel suntan lotion braclet is formed from a tubular body configured in the shape of a ring. The interior of the tubular body forms a chamber for receiving liquid suntan lotion. The suntan lotion bracelet would normally be formed from a plastic material and its most popular size would probably hold between ½ and 2 ounces of suntan lotion. The suntan lotion bracelet is preferrably made of a medical grade of PVC that will not contaminate the suntan lotion. The plastic must be flexible enough so that it is squeezable for dispensing the suntan lotion yet strong enough to maintain its shape and not crimp when being formed into its ring configuration. The hardness of the plastic should preferrable be in the range of 50–80 durometers.

In certain versions of the suntan lotion bracelet, the tubular body would be open at its opposite ends and these ends would respectively receive a female end cap and a male end cap that are detachably engagable with each other. The female end cap would have a neck portion having an orifice therein which could be used both for filling and dispensing the suntan lotion. The end caps can be secured to the ends of the tubular body by various different methods, some of which would be by solvent bonding, by ultrasonic bonding, etc.

Other versions of the suntan lotion bracelet would have the tubular body formed as an integrally formed ring that has a neck portion support wall formed on one of its outer surfaces. A neck portion would extend upwardly therefrom and it would have an orifice in its top end for filling and dispensing the suntan lotion. Several types of caps can be used to close the orifice.

DESCRIPTION OF THE PREFERRED EMBODIMENT

Figure 1:
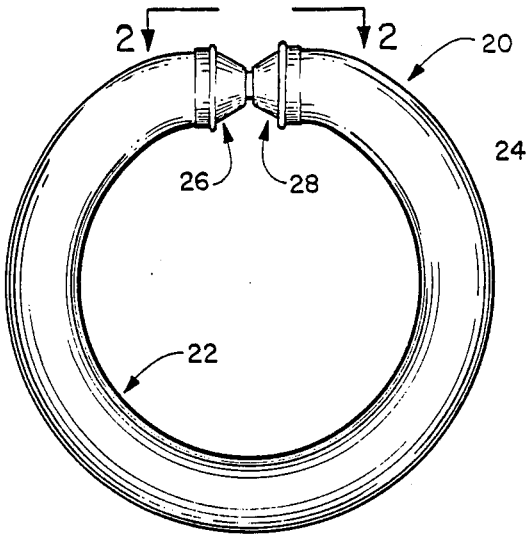
FIG. 1 is a side elevation view of applicant's novel suntan lotion bracelet.
Figure 2:
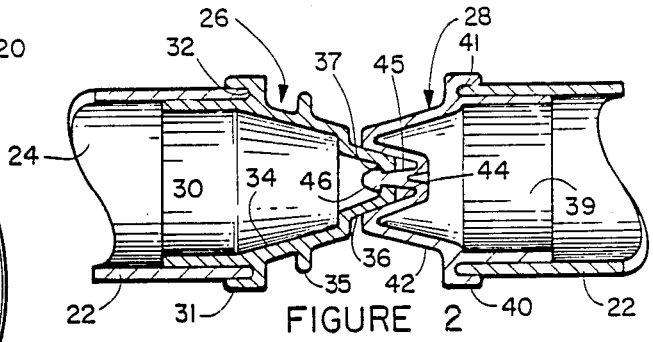
FIG. 2 is a cross sectional view taken along lines 2—2 of FIG. 1.

Applicant's novel suntan lotion bracelet will now be described by referring to FIGS. 1–21 of the drawings.

The suntan lotion bracelet is generally designated numeral 20.

Suntan lotion bracelet 20 has a tubular body 22 configured in the shape of a ring. The interior of tubular body 22 forms a chamber 24 for receiving liquid suntan lotion. A female end cap 26 and a male end cap 28 are detachably engaged to each other and they are respectively received in the opposite open ends of tubular body 22.

Female end cap 26 has a tubular sleeve portion 30. An annular lip 31 extends outwardly and laterally along a portion of tubular sleeve portion 30 to form an annular channel 32 which receives the open end of tubular body 22. Female end cap 26 also has a conical body portion 34 having an annular fingernail push ring 35. A nozzle portion 36 extends from one end of conical body portion 34 and it has an orifice 37 at its forward end.

Male end cap 28 has a tubular sleeve portion 39 that has a radially outwardly extending annular lip 40 that extends parallel to tubular sleeve portion 39 a predetermined distance to form an annular channel 41 which receives the open end of tubular body 22. A conical body portion 42 extends from one end of tubular sleeve portion 39 and it has an annular recess 44 that has a neck portion 45 having a spud 46 formed on its top end.

Figure 3:
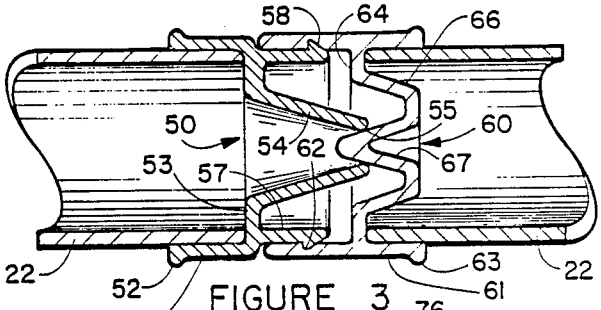
FIG. 3 is a cross sectional elevation view of a first alternative version of the male and female mating end caps.

A first alternative pair of mating end caps is illustrated in FIG. 3. Female end cap 50 has a tubular sleeve portion 51 having an annular finger lug 52 formed on its one end. An annular wall 53 extends inwardly from tubular sleeve portion 51 and it has a nozzle portion 54 having an orifice 55. An annular collar 57 has an annular protrusion 58. Male end cap 60 has a tubular sleeve portion 61 having an annular recess 62 on its inner surface and an annular finger lug 63 on its outer surface. Annular wall 64 extends inwardly from tubular sleeve portion 61 and it has an inverted conical body portion 66 which in turn is connected to a conical neck plug portion 67.

Figure 4:
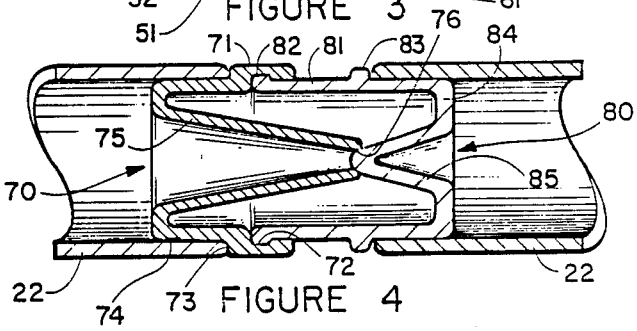
FIG. 4 is a cross sectional elevation view of a second alternative version of the male and female mating end caps.

Illustrated in FIG. 4 is a second alternative pair of mating male and female end caps 70 and 80. Female end cap 70 has a tubular sleeve portion 71 having an annular recess 72 on its inner surface and an annular shoulder 73 on its outer surface. A tubular sleeve 74 has a nozzle portion 75 having an orifice 76. Male end cap 80 has a tubular sleeve portion 81 having an annular protrusion 82 and an annular flange 83. Annular wall 84 extends inwardly and it has a neck plug portion 85 connected thereto. The two end caps have an annular snap fit type connection.

Figure 5:
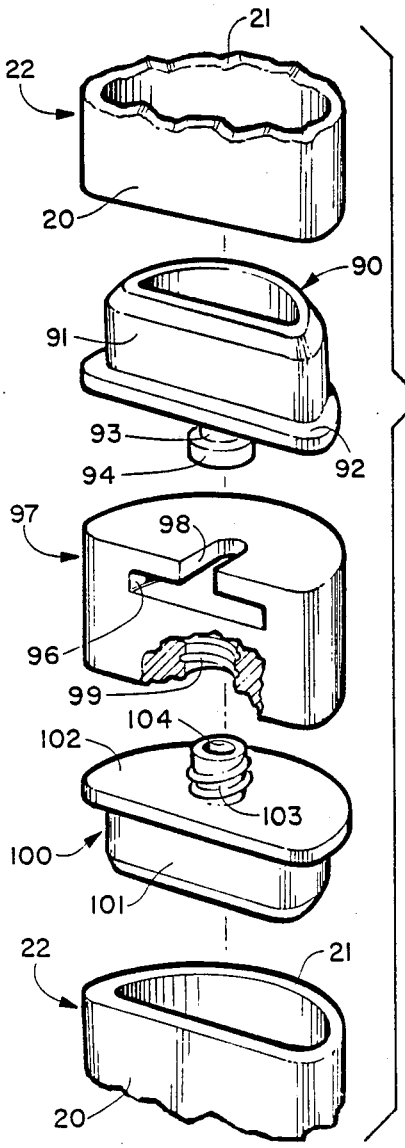
FIG. 5 is a cross sectional elevation view of a third alternative version of the male and female mating end caps.

A third alternative construction for connecting the two opposite ends of tubular body 22 together is illustrated in FIG. 5. Tubular body 20 has an inner wall and an outer wall 21. End plug 90 has a tubular sleeve portion 91 extending upwardly from bottom wall 92. A neck 93 having a head 94 extends downwardly from bottom wall 92. Head 94 is inserted into an open face recess 96 formed in connector screw cap 97. Connecter screw cap 97 has a slot 98 in its one end and a threaded bore 99 in its opposite end. Dispenser end plug 100 has a tubular sleeve portion 101 having a top wall 102. An externally threaded neck portion 103 has an orifice 104.

Figure 6:
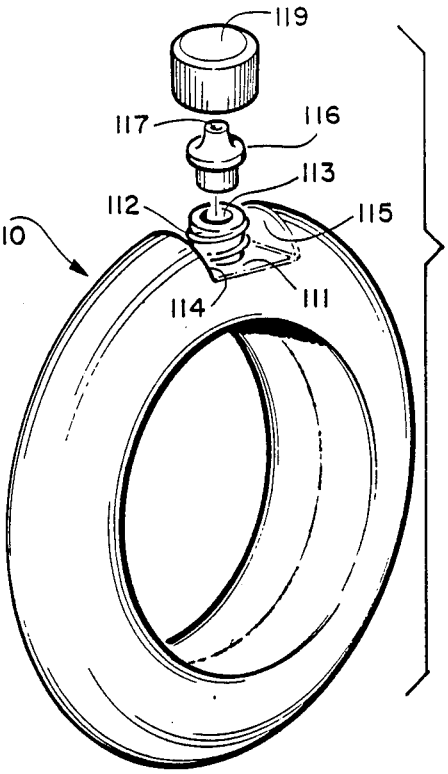
FIG. 6 is a perspective view of a first alternative structure for the suntan lotion bracelet.

A first alternative structure for the suntan lotion bracelet is designated numeral 110 and is illustrated in FIG. 6. It has a neck portion support wall 111 having a threaded neck portion 112 extending upwardly therefrom and having an orifice 113 in its upper end. Side walls 114 and 115 also extend upwardly from neck portion support wall 111. The flow restrictor plug 116 having an orifice 117 is removably received in orifice 113. A cap 119 is threaded onto externally threaded neck portion 112.

Figure 7:
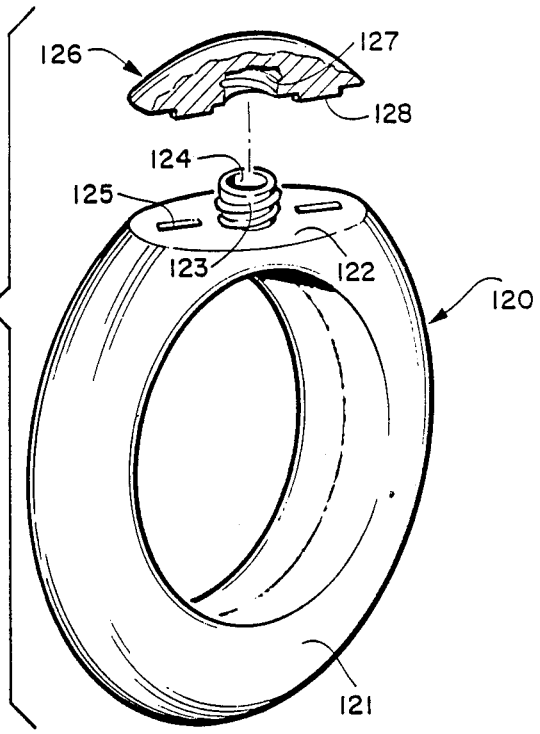
FIG. 7 is a perspective view of a second alternative structure for the suntan lotion bracelet.

In FIG. 7 a second alternative version of the suntan lotion bracelet is illustrated and it is generally designated numeral 120. It has a tubular body 121 having a neck portion support wall 122. Extending upwardly therefrom is a threaded neck portion 123 having an orifice 124 at its top end. Orientation recesses 125 are formed in the top surface of neck portion support wall 122. A twist cap 126 has a threaded bore 127 in its bottom end and extending downwardly therefrom are orientation tabs 128.

Figure 9:
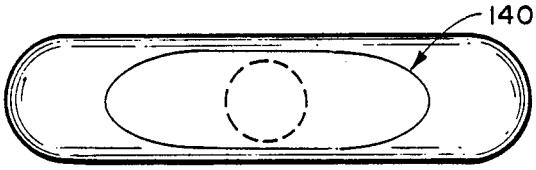
FIG. 9 is a top plan view of the third alternative structure for the suntan lotion bracelet.
Figure 10:
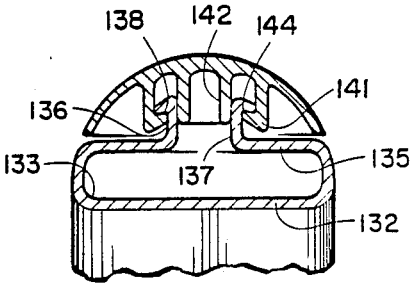
FIG. 10 is a cross sectional view taken along lines 10—10 of FIG. 8.
Figure 8:
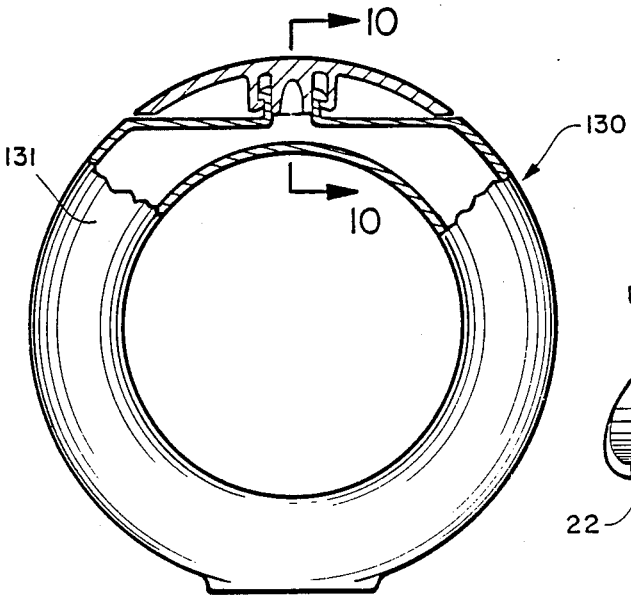
FIG. 8 is a side elevation view of a third alternative structure for the suntan lotion bracelet with portions broken away.

The third alternative version of the suntan lotion bracelet is illustrated in FIGS. 8–10 and is generally designated numeral 130. It has a tubular body 131 having an inner wall 132 and a suntan lotion chamber 133. A neck portion support wall 135 has a neck portion 136 extending upwardly therefrom having an orifice 137 at its top end and an outwardly extending flange 138 at its top end. A cap 140 has an outer annular sleeve 141 and an inner annular sleeve 142 extending downwardly therefrom. An annular lip 144 extends inwardly from outer annular sleeve 141 and latches with annular flange 138.

Figure 11:
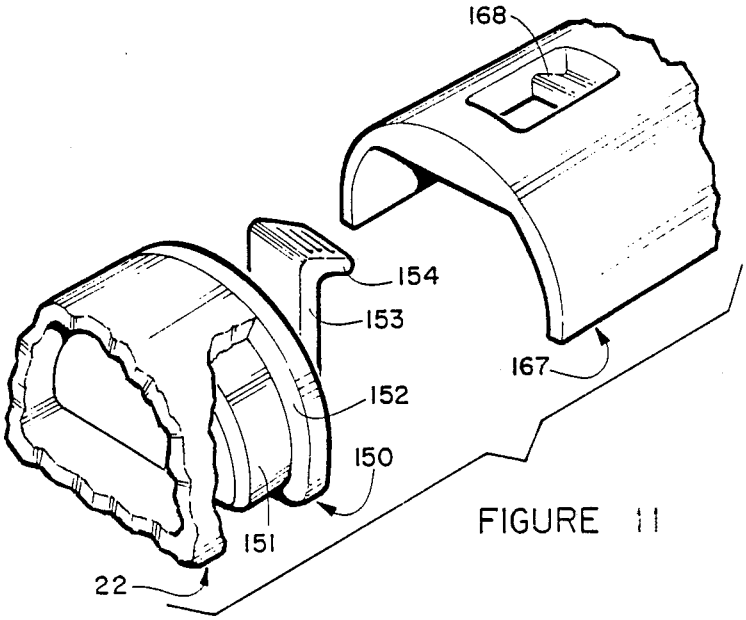
FIG. 11 is a perspective view of a fourth alternative version of the male and female end caps of the novel suntan lotion bracelet.
Figure 12:
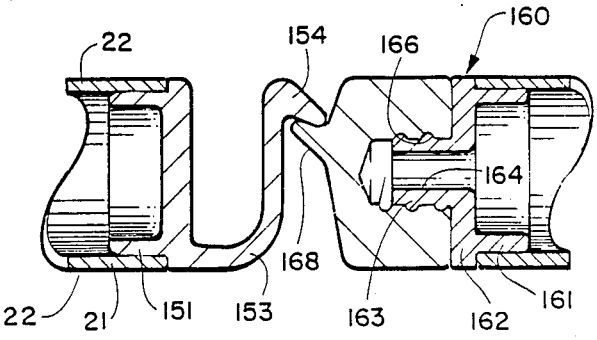
FIG. 12 is a cross sectional elevation view of the fourth alternative version of the male and female end caps of the novel suntan lotion bracelet.
Figure 13:
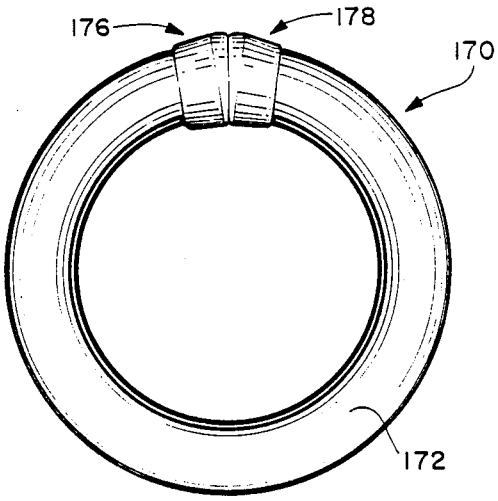
FIG. 13 is a front elevation view of a fifth alternative version of the male and female end caps of the novel suntan lotion bracelet.
Figure 14:
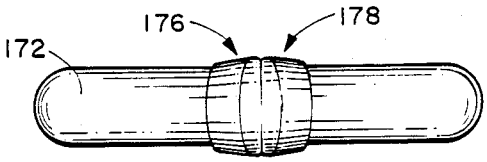
FIG. 14 is a top plan view of the suntan lotion bracelet illustrated in FIG. 13.
Figure 15:
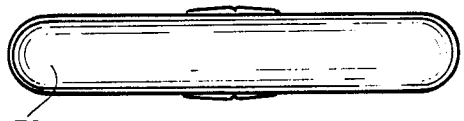
FIG. 15 is a bottom plan view of the suntan lotion bracelet illustrated in FIG. 13.
Figure 16:
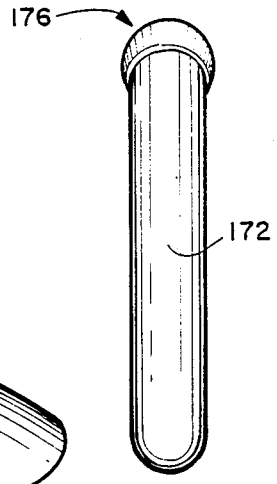
FIG. 16 is a left side elevation view of the suntan lotion bracelet illustrated in FIG. 13.
Figure 17:
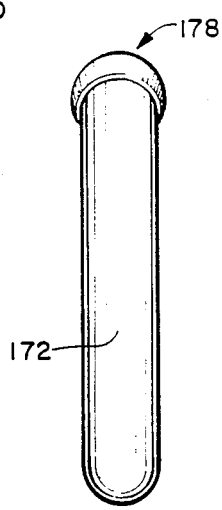
FIG. 17 is a right side elevation view of the suntan lotion bracelet illustrated in FIG. 13.
Figure 18:
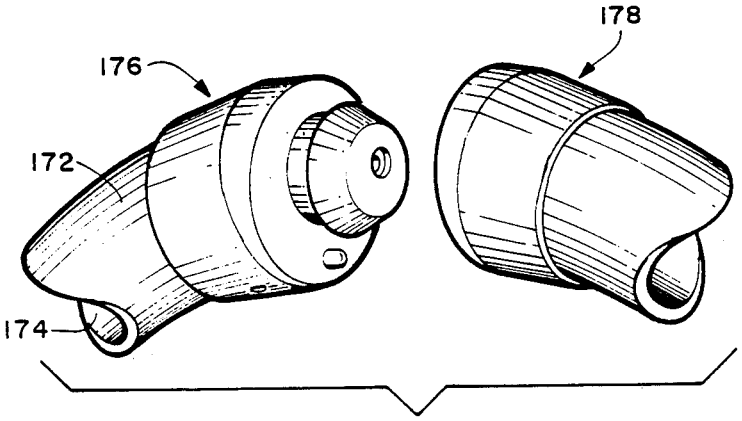
FIG. 18 is a front perspective view of the end caps of the fifth alternative version in their open position.
Figure 19:
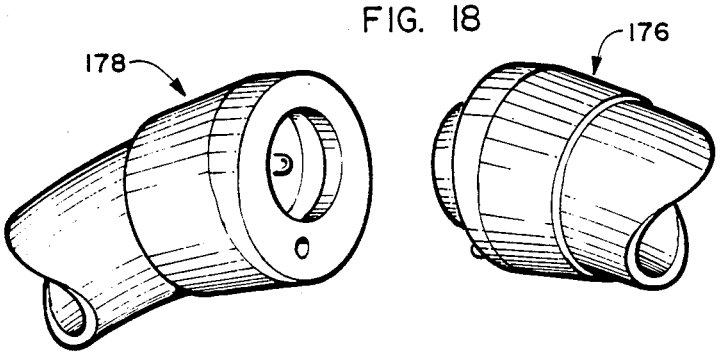
FIG. 19 is a rear perspective view of the end caps of the fifth alternative version in their open position.
Figure 20:
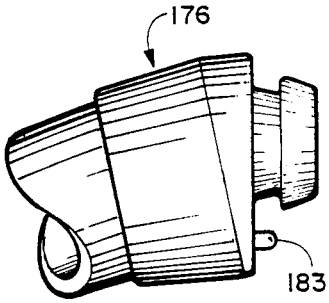
FIG. 20 is a side elevation view of the male end cap illustrated in FIG. 18.
Figure 21:
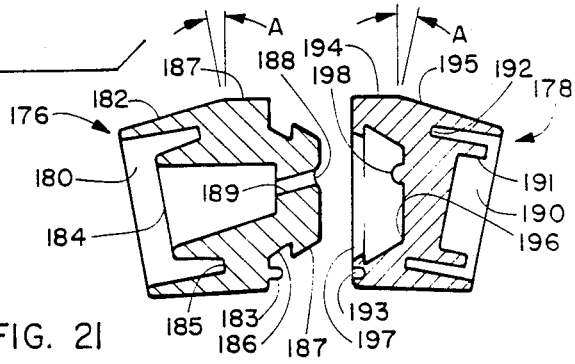
FIG. 21 is a vertical cross sectional view of the end caps.

In FIGS. 11 and 12 a fourth alternative version of interlocking end caps is illustrated. End plug 150 has a tubular sleeve portion 151 and a wall 152 connected thereto. A latch finger 153 extends forwardly and upwardly from wall 152 and its has a tongue 154 extending angularly downwardly from its top end. A dispenser end plug 160 has a tubular sleeve portion 161 with an end wall 162 attached thereto. An externally threaded-neck portion 163 extends upwardly therefrom and has an internal orifice 164. Neck portion 163 is engaged in threaded bore 166 of connector screw cap 167. A lip 168 extends angularly upwardly from the front end of connector screw cap 167 and it forms a structure for capturing tongue 154.

In FIGS. 13–20 a fifth alternative version of interlocking end caps is illustrated. The suntan lotion bracelet is generally designated numeral 170. It has a tubular body 172 configured in the shape of a ring. The interior of tubular body 172 forms a chamber 174 for receiving liquid suntan lotion. A male end cap 176 and a female end cap 178 are detachably engaged to each other and they are respectively received in the opposite open ends of tubular body 172.

Male end cap 176 has a tubular sleeve portion 180 having a forward portion 181 and a rear portion 182 and these two portions meet at an angle A which in the preferred embodiment is approximately 15 degrees. An inner annular sleeve 184 is spaced inwardly from tubular sleeve portion 180 to form an annular channel 185. Extending from the front end of the male end cap is a neck portion 186 having a head 187 formed thereon. A recess 188 is formed in the top surface of head 187 and it is in communication with a bore 189 through which a suntan lotion can be dispensed.

Female end cap 178 has a tubular sleeve portion 190. Spaced inwardly therefrom is an inner annular sleeve 191 and together they form an annular channel 192. Tubular sleeve portion 190 is formed from a forward portion 194 and a rearward portion 195. They meet at an angle A which for this preferred embodiment is substantially 15 degrees. The reason for this change in angle between the forward portion and the rearward portion is to allow the male end cap and female end caps to mate with each other while at the same time allowing the tubular body 172 to maintain a substantially circular ring shape. The front end of female end cap 178 has a head receptacle cavity 196 having an annular flange 197 along its forward end. The rear of the head receptacle cavity has a protrusion 198 that mates with recess 188 to close off the bore 189.

What is claimed is:

1. A suntan lotion bracelet comprising:

an elongated tubular body having open opposite ends and also having a predetermined outer diameter, said tubular body being hollow throughout its entire length to form a single chamber for receiving liquid suntan lotion;

a first end cap received in one end of said tubular body, said first end cap having an orifice in it for dispensing suntan lotion therethrough, said orifice being spaced inwardly a predetermined distance from the outer circumference of said tubular body;

a second end cap received in the other end of said tubular body, said second end cap forming a solid wall that closes this end of said tubular body; and one of said end caps having female configured mating structure on its outer end and said other end cap having male configured mating structure on its outer end and when said mating end caps are detachably connected to each other they form a closed loop ring structure and seal said orifice.

2. A lotion bracelet as recited in claim 1 wherein said tubular body contains a predetermined amount of suntan lotion.

3. A lotion bracelet as recited in claim 1 wherein said female and cap has a nozzle portion and said means for filling and dispensing the liquid lotion is an orifice in said nozzle portion.

4. A lotion bracelet as recited in claim 3 wherein said male end cap has a neck portion for closing said orifice.

5. A lotion bracelet as recited in claim 4 wherein the neck portion of said male end cap has a spud formed on it whose diameter is slightly larger than the interior diameter of said orifice.

6. A lotion braclet as recited in claim 1 wherein said tubular body has an inner wall whose external surface is substantially planar and an outer wall whose cross sectional configuration is substantially convex.

7. A lotion bracelet as recited in claim 6 wherein said tubular body has first and second open ends that respectively receive an end plug and a dispenser end plug and said means for filling and dispensing said lotion bracelet is an orifice in said dispenser end plug, a connector screw cap has structure for detachably connecting it to both said end plug and said dispenser end plug.

8. A lotion braclet as recited in claim 1 wherein said lotion bracelet is made of plastic material.

9. A method of using suntan lotion comprising the following steps:

(a) placing a hollow flexible tubular bracelet whose opposite ends are connected together by detachably interengaging end closure caps, the bracelet being formed in the shape of a closed loop ring having its interior chamber containing suntan lotion on the arm or ankle of a person going out to enjoy the sunshine;

(b) removing the bracelet sometime later, pulling the end caps of the bracelet apart, squeezing an amount of suntan lotion out of said bracelet and applying this to desired areas of their body; and (c) reconnecting the ends of the bracelet containing suntan lotion and placing it back on their arm or ankle.

* * * * *